US006261167B1

(12) United States Patent
Watson et al.

(10) Patent No.: US 6,261,167 B1
(45) **Date of Patent: *Jul. 17, 2001**

(54) TWO-SIDED ABRASIVE TOOL AND METHOD OF ASSEMBLING SAME

(75) Inventors: Stanley A. Watson, Franklin; David G. Powell, Wellesley Hills, both of MA (US)

(73) Assignee: Diamond Machining Technology, Inc., Marlborough, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/212,113

(22) Filed: Dec. 15, 1998

(51) Int. Cl.[7] ..... B24D 11/00

(52) U.S. Cl. ..... 451/526; 451/533; 451/577; 407/29.1

(58) Field of Search ..... 451/533, 526, 451/557; 407/29.1, 29.14, 29.15

(56) References Cited

U.S. PATENT DOCUMENTS

| | | | | |
|---|---|---|---|---|
| 2,156,717 | | 5/1939 | Bendure | 51/186 |
| 2,175,073 | * | 10/1939 | Amstuz | 451/533 |
| 2,360,798 | | 10/1944 | Seligman et al. . | |
| 2,906,612 | | 9/1959 | Anthony et al. | 51/309 |
| 3,141,270 | * | 7/1964 | Ferrand | 451/557 |
| 3,287,862 | | 11/1966 | Abernathy . | |
| 3,495,359 | | 2/1970 | Smith et al. | 51/204 |
| 3,517,464 | | 6/1970 | Mattia et al. . | |
| 3,785,938 | | 1/1974 | Sam | 204/16 |
| 3,835,598 | | 9/1974 | Tobey | 51/396 |
| 3,860,400 | | 1/1975 | Prowse et al. . | |
| 3,956,858 | * | 5/1976 | Catlin et al. | 451/557 |
| 4,047,902 | | 9/1977 | Wiand . | |
| 4,078,906 | | 3/1978 | Green . | |
| 4,079,552 | | 3/1978 | Fletcher . | |
| 4,155,721 | | 5/1979 | Fletcher . | |
| 4,256,467 | | 3/1981 | Gorsuch . | |
| 4,381,227 | | 4/1983 | Narcus | 204/16 |
| 4,460,382 | | 7/1984 | Ohno . | |
| 4,560,853 | | 12/1985 | Ziegel | 219/121 LD |
| 4,608,128 | | 8/1986 | Farmer et al. | 204/16 |
| 4,826,508 | | 5/1989 | Schwartz et al. . | |

(List continued on next page.)

FOREIGN PATENT DOCUMENTS

| | | | |
|---|---|---|---|
| 0 238 434 A2 | 9/1987 | (EP) | C23C/24/00 |
| 1 229 980 | 4/1971 | (GB) | B24D/17/00 |
| WO 93/04818 | 3/1993 | (WO) | B24D/3/06 |
| WO 96/14963 | 5/1996 | (WO) | B24D/5/12 |

OTHER PUBLICATIONS

Diamond Machining Technology, Inc., Unique Diamond Sharpening Products For Industry (1996).

Miller, Paul C., "Cutting–tool coatings: Many strengths," Tooling & Production, Sep., 1991, pp. 34–37.

Advanced Materials and Processes, "Ford Focus has hybrid plastic–metal front end" (Mar. 1999).

*Primary Examiner*—M. Rachuba
(74) *Attorney, Agent, or Firm*—Kirkpatrick & Lockhart LLP

(57) ABSTRACT

An abrasive tool includes a first perforated sheet having a front surface and a back surface, and a second perforated sheet having a front surface and a back surface. A first layer of abrasive grains is bonded to the front surface of the first perforated sheet and a second layer of abrasive grains is bonded to the front surface of the second perforated sheet. A core is made of a first material, the core having a first surface and a second surface, the back surface of the first perforated sheet disposed adjacent to the first surface of the core and the back surface of the second perforated sheet disposed adjacent to the second surface of the core, the core being bonded to the first perforated sheet and the second perforated sheet by forming the core between the first perforated sheet and the second perforated sheet.

32 Claims, 5 Drawing Sheets

U.S. PATENT DOCUMENTS

| | | | | |
|---|---|---|---|---|
| 4,874,478 | | 10/1989 | Ishak et al. | 204/16 |
| 4,945,686 | | 8/1990 | Wiand . | |
| 4,951,423 | * | 8/1990 | Johnson | 451/526 |
| 5,022,895 | | 6/1991 | Wiand . | |
| 5,049,165 | | 9/1991 | Tselesin . | |
| 5,109,637 | * | 5/1992 | Calafut | 451/533 |
| 5,131,924 | | 7/1992 | Wiand . | |
| 5,133,782 | | 7/1992 | Wiand . | |
| 5,154,550 | | 10/1992 | Isobe et al. | 408/144 |
| 5,161,335 | | 11/1992 | Tank . | |
| 5,176,155 | * | 1/1993 | Rudolph, Jr. | 451/533 |
| 5,203,881 | | 4/1993 | Wiand . | |
| 5,317,839 | | 6/1994 | Anderson . | |
| 5,573,453 | * | 11/1996 | Tiefenbach, Jr. | 451/533 |
| 5,919,084 | * | 7/1999 | Powell et al. | 451/557 |
| 5,976,001 | * | 11/1999 | Powell et al. | 451/557 |

* cited by examiner

TWO-SIDED ABRASIVE TOOL AND METHOD OF ASSEMBLING SAME

BACKGROUND OF THE INVENTION

This invention relates to an abrasive tool, and in particular, a tool with two abrasive sides bonded to a core.

An abrasive tool may be used to sharpen, grind, hone, lap or debur a work piece or substrate of hard material, e.g., a knife. Such an abrasive tool may have a surface coated with abrasive grains such as diamond particles.

An abrasive tool having an abrasive surface with depressions, e.g., an interrupted cut pattern, is known to be effective for chip clearing when applied to various work pieces. Abrasive tools must be rigid and durable for many commercial and industrial applications.

SUMMARY OF THE INVENTION

In general, in one aspect, the invention features an abrasive tool, including a first perforated sheet having a front surface and a back surface, and a second perforated sheet having a front surface and a back surface. A first layer of abrasive grains is bonded to the front surface of the first perforated sheet and a second layer of abrasive grains bonded to the front surface of the second perforated sheet. A core is made of a first material, the core having a first surface and a second surface, the back surface of the first perforated sheet disposed adjacent to the first surface of the core and the back surface of the second perforated sheet disposed adjacent to the second surface of the core, the core being bonded to the first perforated sheet and the second perforated sheet by forming the core between the first perforated sheet and the second perforated sheet.

Implementations of the invention may include one or more of the following features. The core may be formed between the first perforated sheet and the second perforated sheet by injection molding, casting or laminating. The first material may include a plastic material, which may be a glass filled polycarbonate composite. The first material may include resin, epoxy or a cementitious material.

The first and second perforated sheets may have perforations that are counterbored or bevelled such that a portion of each of the perforations adjacent to the front surfaces of the sheets is wider than a portion of each of the perforations that is adjacent to the back surfaces of the sheets. The first material may be disposed within the counterbored or bevelled perforations to anchor the perforated sheets to the core.

The first and second perforated sheets may have perforations arranged to form an interrupted cut pattern. The first and second perforated sheets may have perforations in a portion less than the entirety of the sheets.

The first and second layers of abrasive grains may be bonded to the front surfaces of the first and second perforated sheets respectively by a plating material. The first and second layers of abrasive grains may have different degrees of abrasiveness.

The tool may be a file or a whetstone.

In general, in another aspect, the invention features a method of assembling an abrasive tool. A first perforated sheet having a front surface and a back surface and perforations therein, and a second perforated sheet having a front surface and a back surface and perforations therein, are provided. The back surfaces of the first and second perforated sheets are oriented to be spaced apart from and facing each other. A core is formed between the spaced apart back surfaces of the first and second perforated sheets. A first layer of abrasive grains is bonded to the front surface of the first perforated sheet, and a second layer of abrasive grains is bonded to the front surface of the second perforated sheet.

Implementations of the invention may include one or more of the following features. The core may be formed by injecting a first material between the spaced apart back surfaces of the first and second perforated sheets, and the first material is hardened. The first material injected between the spaced apart back surfaces of the first and second perforated sheets may flow into the perforations in the first and second perforated sheets. The core may also be formed by casting or laminating. The orienting step may include placing the first and second perforated sheets into a mold.

The method may also include grinding the front surfaces of the first and second perforated sheets. The bonding of the first and second layers of abrasive grains to the front surfaces of the first and second perforated sheets respectively may include electroplating, anodizing or brazing.

In general, in another aspect, the invention features an abrasive tool including a perforated sheet having a front surface and a back surface. A layer of abrasive grains is bonded to the front surface of the perforated sheet. A core is made of a first material and has a first surface, the back surface of the perforated sheet disposed adjacent to the first surface of the core, the core being bonded to the perforated sheet by forming the core adjacent to the perforated sheet.

In general, in another aspect, the invention features an abrasive tool, including a first sheet having a front surface, a back surface and a first anchoring member, and a second sheet having a front surface, a back surface and a second anchoring member. A first layer of abrasive grains is bonded to the front surface of the first sheet, and a second layer of abrasive grains is bonded to the front surface of the second sheet. A core is made of a first material, the core having a first surface and a second surface, the back surface of the first sheet disposed adjacent to the first surface of the core and the back surface of the second sheet disposed adjacent to the second surface of the core, the core being bonded to the first anchoring member of the first sheet and the second anchoring member of the second sheet by forming the core between the first sheet and the second sheet.

An advantage of the present invention is the ease and simplicity of using injection molding to form the core for the abrasive tool.

Another advantage of the present invention is the strength, durability, and dimensional stability of the abrasive tool, which allows for selection from a wide range of materials and yields desired properties.

Another advantage of the present invention is the high strength to weight ratios of the composite material used to form the core compared to any of the construction materials singularly.

Another advantage of the present invention is the economies of scale that can be achieved by fabricating a single tool with multiple abrasive surfaces.

A further advantage is the versatility of the abrasive tool, which may have varying shapes and different grades of abrasiveness for each of the surfaces.

Other features and advantages of the invention will become apparent from the following detailed description, and from the claims.

DESCRIPTION OF THE PREFERRED EMBODIMENTS

An abrasive tool according to the present invention includes a core formed between two sheets, with abrasive grains being bonded to the sheets to form abrasive surfaces.

Figure 1:
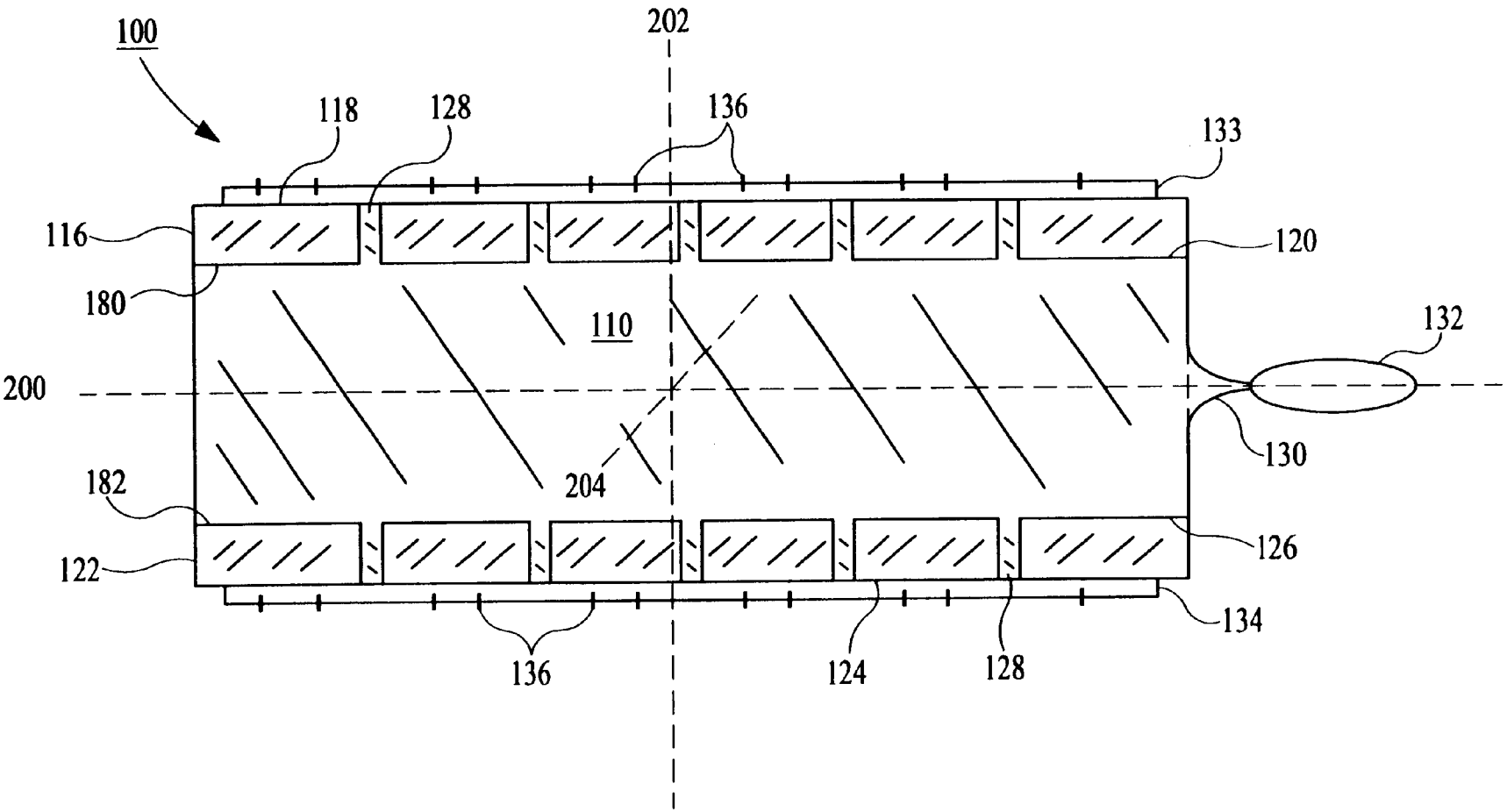
FIG. 1 is a diagrammatic, sectional side view of a file constructed according to the present invention.
Figure 2:
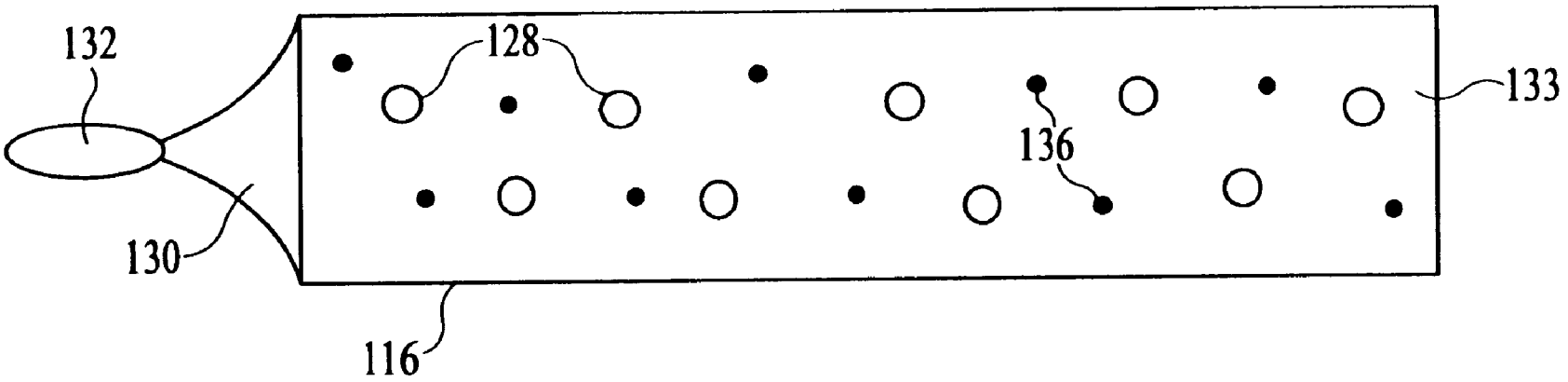
FIG. 2 is a diagrammatic plan view of the upper surface of the file of FIG. 1.
Figure 3:
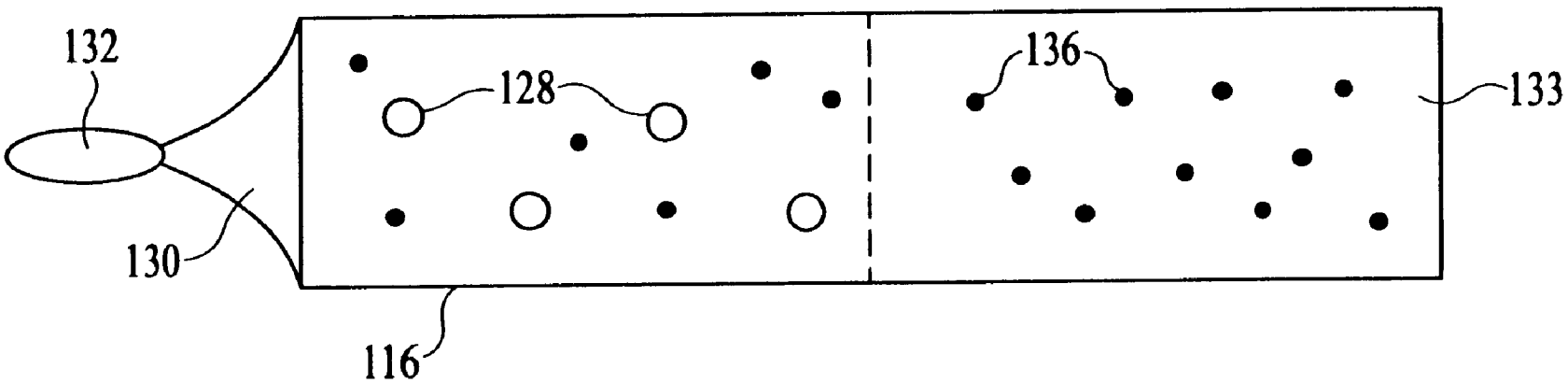
FIG. 3 is a diagrammatic plan view of an alternate embodiment of the upper surface of the file of FIGS. 1 and 2 which is perforated only over a portion of its abrasive surface.

As shown in FIGS. 1, 2 and 3, the abrasive tool may be a hand-held file 100. The abrasive tool may also be, e.g., a whetstone, a grinding wheel or a slip stone.

File 100 includes a core 110 having a first surface 180 and a second surface 182, and sheets 116, 122. Sheets 116, 122 have front surfaces 118, 124 and back surfaces 120, 126, respectively. File 100 may also include a lateral projection 130 integrally formed with core 110, to which a handle 132 or other support structure may be attached.

Sheets 116, 122 are preferably made from a hard metal such as steel, but may be made of any metal, e.g., stainless steel or aluminum. Further, sheets 116, 122 may be made of a magnetic material. Depending on the type of metal used to make the sheets, the sheets or the finished abrasive tool may be magnetically clamped during processing, i.e. injection molding or grinding, or in use. Sheets 116, 122 contain perforations, e.g., round holes 128, extending through sheets 116, 122. The perforations may have any shape, e.g., square, circular, or diamond shaped holes. Further, sheets 116, 122 may have any shape, e.g., flat, round, conical or curved.

Figure 4C:
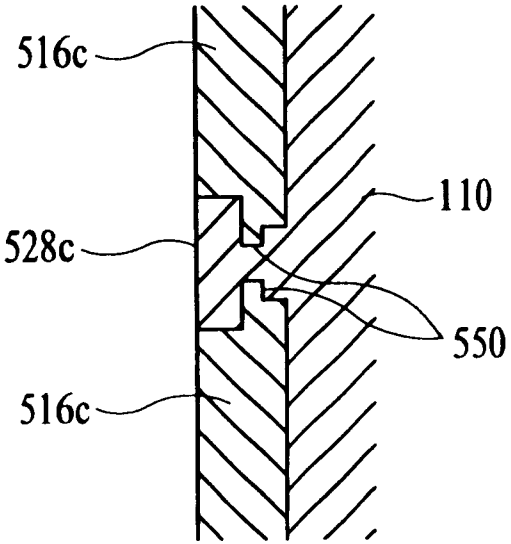
FIGS. 4A–4C show diagrammatic, fragmentary cross-sectional views of anchoring members in the sheets used to construct a file according to the present invention.
Figure 4B:
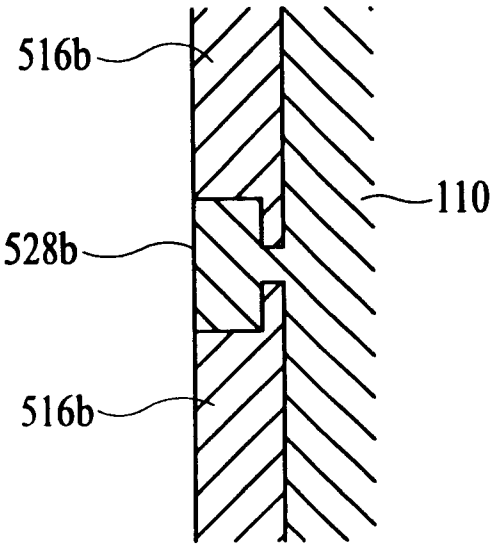
Figure 4A:
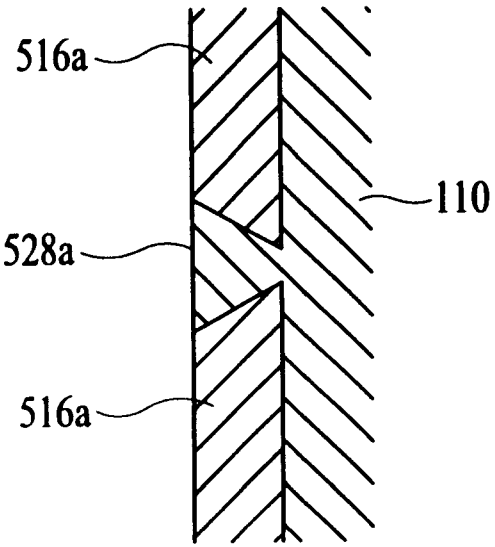

As seen in FIGS. 4A–4C, the perforations are preferably bevelled or counterbored holes which form anchoring members to anchor sheets 516*a*–516*c* to the core. The bevelled counterbored holes may have a variety of different configurations. FIG. 4A shows a beveled hole 528*a* in sheet 516*a*. FIGS. 4B and 4C both show stepped counterbored holes 528*b* and 528*c*, with hole 528*c* having projections 550. Other bevelled or counterbored configurations perform the same function. The essential feature of such a bevelled or counterbored hole is that some portion of the perforation that is closer to the front surface of the sheet is broader or wider, in a plane parallel to the sheet, than at least some portion of the perforation that is closer to the back surface of the sheet.

A pattern of perforations is known as an interrupted cut pattern. As illustrated in FIG. 2, a preferred embodiment of the present invention has an interrupted cut pattern with sheets for which 40% of the surface area has been cut out for the perforations. In an alternate embodiment, only a portion of each of sheets 116, 122 contains perforations, while the remainder contains no perforations (FIG. 3). Any arbitrary portion of sheets 116, 122 may contain perforations to form an interrupted cut pattern, such that the majority of the area of each sheets forms a continuous surface.

The back surfaces 120, 126 of sheets 116, 122, respectively, are bonded to the first and second surfaces 180, 182 of core 110, which is formed between sheets 116, 122. Core 110 may be formed by injection molding, casting or laminating. Core 110 is preferably made from a plastic material, preferably a glass filled polycarbonate composite (e.g., 40% glass filled polycarbonate). Such a composite material has an inherently higher strength to weight ratio than any of the individual materials used to form the composite. Alternatively, the core may be made of a resin, epoxy or cementitious material. Further, core 110 may be any shape, e.g., flat, round, conical or curved, depending on the shape of sheets 116, 122.

Figure 5:
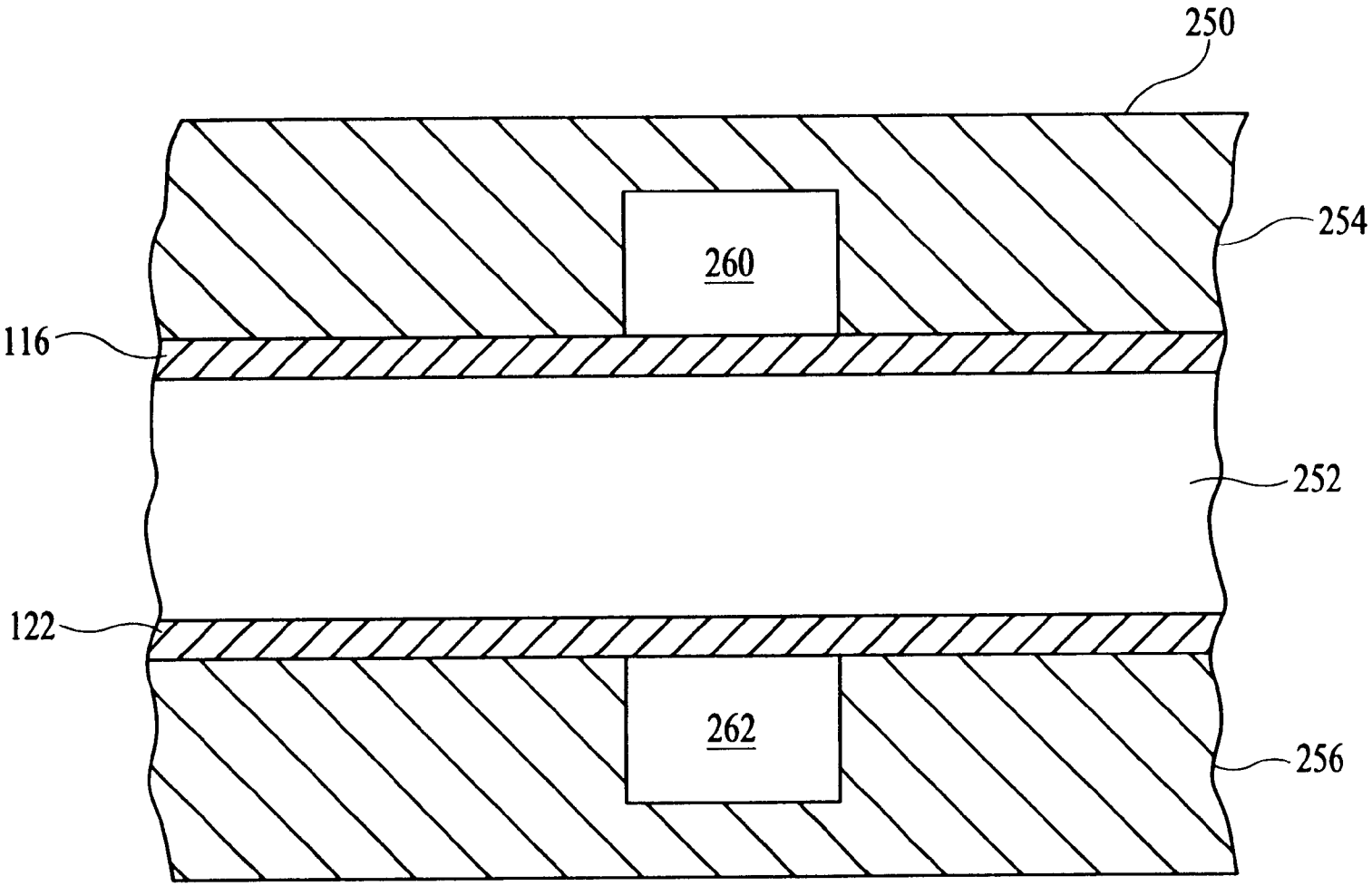
FIG. 5 is a diagrammatic, sectional side view of a mold for constructing a file according to the present invention.

As shown in FIG. 5, core 110 is formed between perforated sheets 116, 122 using a mold 250. The mold may have steel frame portions 254, 256 containing magnets 260, 262. The sheets may be held within mold cavity 252 using, e.g., magnets 260, 262. Back surfaces 120, 126 of sheets 116, 122 are held spaced apart from each other, creating a space within mold cavity 252 in which the core is formed.

Sheets 116, 122 are bonded to core 110 by injection molding, casting or laminating. For example, to form file 100, a liquid or semi-solid material, e.g., heated plastic material, that forms core 110 may be forced between sheets 116, 122 under injection pressure. During the injection molding, the liquid or semi-solid material flows into the space to create the core and flows into the perforation holes 128 in sheets 116, 122. The liquid or semi-solid material hardens, by cooling or curing, to form the core. Core 110 is then anchored to sheets 116, 122, since the core material that has flowed into perforation holes 128 resists separation of core 110 from sheets 116, 122, particularly if the perforation holes are counterbored or bevelled as described above.

Abrasive surfaces 133, 134 are formed on front surfaces 118, 124 of sheets 116, 122. Abrasive surfaces 133, 134 may be, e.g., grinding, honing, lapping or deburring surfaces, and may be, e.g., flat or curved, depending on the shape and use of the abrasive tool.

Abrasive surfaces 133, 134 are formed by bonding abrasive grains 136 to front surfaces 118, 124 of sheets 116, 122 in areas other than holes 128. Abrasive grains 136 do not bond to the core material, e.g., plastic, within holes 128. Since abrasive surfaces 133, 134 extend above the surface of sheets 116, 122, front surfaces 118, 124 of sheets 116, 122 have an interrupted cut pattern which provides recesses into which filed or deburred particles or chips may fall while the abrasive tool is being used on a work piece. An abrasive tool with an interrupted cut pattern is able to cut or file the work piece faster by virtue of providing chip clearance.

Abrasive grains 136 may be particles of, e.g., superabrasive monocrystalline diamond, polycrystalline diamond, or cubic boron nitride. Abrasive grains 136 may be bonded to front surfaces 118, 124 of sheets 116, 122 by electroless or electrode plated nickel or other plating material or bonding, or by brazing if the core is made of suitably high temperature resistant material.

Abrasive surfaces 133, 134 may be given the same degree of abrasiveness by subjecting front surfaces 118, 124 of sheets 116, 122 to identical processes. Alternately, the abrasive surfaces 133, 134 may be given differing degrees of abrasiveness, by bonding different types, sizes, or concentrations of abrasive grains 136 onto the two front surfaces 118, 124 of sheets 116, 122.

Abrasive grains 136 may be bonded to front surfaces 118, 124 of sheets 116, 122 by electroplating or anodizing nickel precharged with diamond. See, e.g., U.S. Pat. No. 3,287,862, which is incorporated herein by reference. Electroplating is a common bonding technique for most metals that applies Faraday's law. For example, the sheets 116, 122 bonded to core 110 are attached to a negative voltage source and placed in a suspension containing positively charged nickel ions and diamond particles. As diamond particles fall onto front surfaces 118, 124 of sheets 116, 122, nickel builds up around the particles to hold them in place. Thus, the diamond particles bonded to front surfaces 118, 124 of sheets 116, 122 are partially buried in a layer of nickel.

In addition, holes 128 in sheets 116, 122 may be filled or covered with a resist material before bonding the diamond particles to avoid depositing diamond particles inside holes 128. The resist material may be, e.g., a resin. The resist material may be left in place or removed from holes 128 after the diamond particles have been bonded to front surfaces 118, 124 of sheets 116, 122.

Alternately, abrasive grains 136 such as diamond particles may be sprinkled onto front surfaces 118, 124 of sheets 116, 122, and then a polished steel roller which is harder than sheets 116, 122 may be used to push abrasive grains into front surfaces 118, 124 of sheets 116, 122. For example, in this case sheets 116, 122 may be aluminum.

Alternately, abrasive grains 136 may be bonded to front surfaces 118, 124 of sheets 116, 122 by brazing. For example, to bond diamond particles by brazing, a soft, tacky brazing material or shim, e.g., in the form of a paste, spray or thin solid layer, is applied to the front surfaces 118, 124 of sheets 116, 122. The shim is made, e.g., from an alloy of a metal and a flux material that has a melting point lower than the melting point of sheets 116, 122 or core 110.

Diamond particles are poured onto the shim, which holds many of the diamond particles in place due to its tackiness. Excess diamond particles that do not adhere to the shim may be poured off. Sheets 116, 122 are then heated until the shim melts. Upon solidification, the diamond particles are embedded in the shim, which is also securely bonded to the front surfaces 118, 124 of sheets 116, 122. In addition, diamond particles can be kept out of the holes 128 in sheets 116, 122 by failing to apply the shim material inside holes 128.

Figure 6:
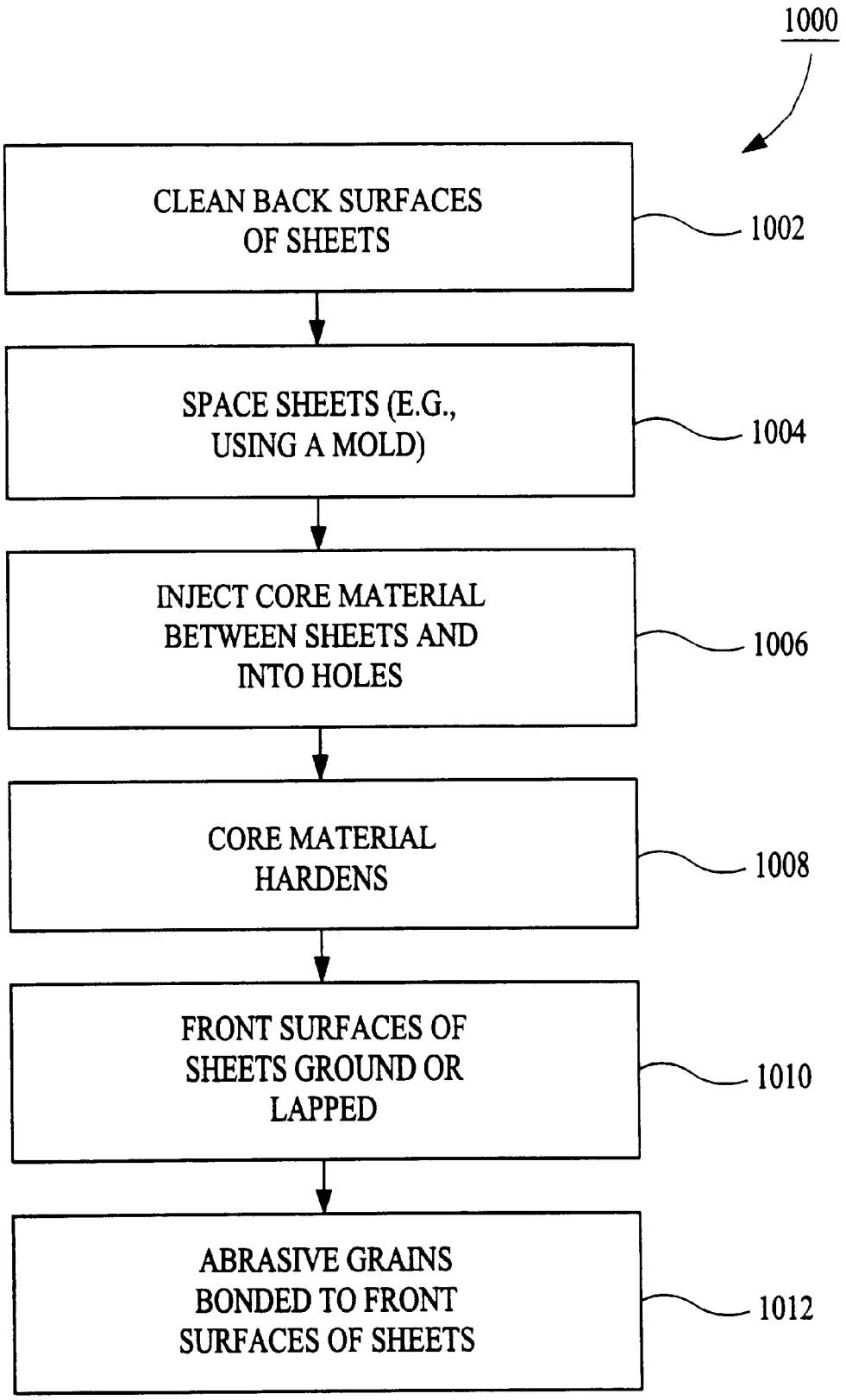
FIG. 6 is a flow chart showing a method of assembling an abrasive tool according to the present invention.

FIG. 6 shows a method 1000 for constructing file 110. First, back surfaces 120, 126 of perforated sheets 116, 122 are cleaned (step 1002).

In step 1004, sheets 116, 122 are spaced apart from each other. For example, sheets 116, 122 may be retained in a spaced orientation within a mold, with back surfaces 120, 126 facing each other.

Core 110 is formed between sheets 116, 122 by injection molding, casting or laminating. With injection molding, liquid or semi-solid core material is injected into the space between sheets 116, 122 and flows into perforation holes 128 (step 1006). The core material then hardens or cures to form the core 110 with sheets 116, 122 bonded thereto (step 1008).

The front surfaces 118, 124 of sheets 116, 122 may be ground or lapped for precision flatness (step 1010). The grinding step also removes any core material that may have flowed though perforation holes 128 and become deposited on one of the front surfaces 118, 124 of the sheets 116, 122.

Abrasive grains 136 are then bonded to front surfaces 118, 124 of sheets 116, 122 to form abrasive surfaces 132, 134 (step 1012).

In a preferred embodiment, sheets 116, 122 are bonded to core 110 (steps 1006 and 1008) prior to forming abrasive surfaces 132, 134 (step 1012). In particular, the use of a non-conductive plastic core material for core 110 minimizes the quantity of grains 136 that are used; i.e., nickel will not be deposited on non-conductive plastic core 110 during the electroplating process, so that no diamond grains 136 will accumulate on core 110. Alternately, abrasive surfaces may be formed on sheets 116, 122 (step 1012) prior to bonding sheets 116, 122 to core 110 (steps 1006 and 1008).

This method of constructing file 100 may be used to construct any abrasive tool structure, including but not limited to the manufacture of a two-sided whetstone.

The core formed between two parallel perforated sheets preferably has symmetrical cross sections in planes in three dimensions, i.e., along the length, width and height axes of the core (200, 202 and 204 in FIG. 1). As a result, the distribution and relief of stresses within each plane are symmetrical during subsequent grinding operations, the net effect being overall dimensional stability of the composite structure. Moreover, an abrasive tool formed by injection molding, casting or laminating the core between two sheets will force shrinking or contracting anisotropically, which helps to control warp or distortion of the tool.

In an alternative embodiment, the abrasive tool includes more than two sheets, and thus more than two abrasive surfaces. For example, the use of sheets made of a magnetic material allows for magnetic or vacuum chucking for multiple sharpening surfaces. Such magnetic sheets allow multiple units to be used simultaneously, in the form of a mosaic, such as for a whetstone.

Other embodiments are within the scope of the following claims.

What is claimed is:

1. An abrasive tool, comprising:

a first perforated sheet having a front surface and a back surface and perforations therein;

a second perforated sheet having a front surface and a back surface and perforations therein;

a first layer of abrasive grains bonded to the front surface of the first perforated sheet;

a second layer of abrasive grains bonded to the front surface of the second perforated sheet; and a unitary core made of a first material, the core having a first surface and a second surface, the back surface of the first perforated sheet disposed adjacent to the first surface of the core and the back surface of the second perforated sheet disposed adjacent to the second surface of the core, the core being bonded to the first perforated sheet and the second perforated sheet by the core formed between the first perforated sheet and the second perforated sheet and the first material being disposed within the perforations of the first and second sheets.

2. The abrasive tool according to claim 1 wherein the core is formed between the first perforated sheet and the second perforated sheet by injection molding.

3. The abrasive tool according to claim 1 wherein the core is formed between the first perforated sheet and the second perforated sheet by casting.

4. The abrasive tool according to claim 1 wherein the core is formed between the first perforated sheet and the second perforated sheet by laminating.

5. The abrasive tool according to claim 1 wherein the first material comprises a plastic material.

6. The abrasive tool according to claim 5 wherein the plastic material is a glass filled polycarbonate composite.

7. The abrasive tool according to claim 1 wherein the first material comprises resin.

8. The abrasive tool according to claim 1 wherein the first material comprises epoxy.

9. The abrasive tool according to claim 1 wherein the first material comprises a cementitious material.

10. An abrasive tool, comprising:

a first perforated sheet having a front surface and a back surface;

a second perforated sheet having a front surface and a back surface;

a first layer of abrasive grains bonded to the front surface of the first perforated sheet;

a second layer of abrasive grains bonded to the front surface of the second perforated sheet; and a core made of a first material, the core having a first surface and a second surface, the back surface of the first perforated sheet disposed adjacent to the first surface of the core and the back surface of the second perforated sheet disposed adjacent to the second surface of the core, the core being bonded to the first perforated sheet and the second perforated sheet by forming the core between the first and the second perforated sheets;

wherein the first and second perforated sheets have perforations that are counterbored such that a portion of each of the perforations adjacent to the front surfaces of the sheets is wider than a portion of each of the perforations that is adjacent to the back surfaces of the sheets.

11. The abrasive tool according to claim 10 wherein the first material is disposed within the counterbored perforations to anchor the perforated sheets to the core.

12. An abrasive tool, comprising:

a first perforated sheet having a front surface and a back surface;

a second perforated sheet having a front surface and a back surface;

a first layer of abrasive grains bonded to the front surface of the first perforated sheet;

a second layer of abrasive grains bonded to the front surface of the second perforated sheet; and a core made of a first material, the core having a first surface and a second surface, the back surface of the first perforated sheet disposed adjacent to the first surface of the core and the back surface of the second perforated sheet disposed adjacent to the second surface of the core, the core being bonded to the first perforated sheet and the second perforated sheet by forming the core between the first and the second perforated sheets;

wherein the first and second perforated sheets have perforations that are bevelled such that a portion of each of the perforations adjacent to the front surfaces of the sheets is wider than a portion of each of the perforations that is adjacent to the back surfaces of the sheets.

13. The abrasive tool according to claim 12 wherein the first material is disposed within the bevelled perforations to anchor the perforated sheets to the core.

14. The abrasive tool according to claim 1 wherein the perforations of the first and second perforated sheets are arranged to form an interrupted cut pattern.

15. The abrasive tool according to claim 1 wherein the perforations of the first and second perforated sheets are in a portion less than the entirety of the sheets.

16. The abrasive tool according to claim 1 wherein the first and second sheets comprise a metallic material and the first and second layers of abrasive grains are bonded to the front surfaces of the first and second perforated sheets respectively by a plating material.

17. The abrasive tool according to claim 1 wherein the first and second layers of abrasive grains have different degrees of abrasiveness.

18. The abrasive tool according to claim 1 wherein the tool is a file.

19. The abrasive tool according to claim 1 wherein the tool is a whetstone.

20. A method of assembling an abrasive tool, comprising:

providing a first perforated sheet having a front surface and a back surface and perforations therein;

providing a second perforated sheet having a front surface and a back surface and perforations therein;

orienting the back surfaces of the first and second perforated sheets spaced apart from and facing each other;

forming a unitary core made of a first material between the spaced apart back surfaces of the first and second perforated sheets, the first material being disposed within the perforations of the first and second sheets;

bonding a first layer of abrasive grains to the front surface of the first perforated sheet; and bonding a second layer of abrasive grains to the front surface of the second perforated sheet.

21. The method of claim 20 wherein the core is formed by injecting a first material between the spaced apart back surfaces of the first and second perforated sheets and the first material is hardened.

22. The method of claim 21 wherein the first material injected between the spaced apart back surfaces of the first and second perforated sheets flows into the perforations in the first and second perforated sheets.

23. The method of claim 20 wherein the core is formed by casting.

24. The method of claim 20 wherein the core is formed by laminating.

25. The method of claim 20 wherein the orienting step includes placing the first and second perforated sheets into a mold.

26. The method of claim 20 further comprising the step of grinding the front surfaces of the first and second perforated sheets.

27. The method of claim 20 wherein the first and second sheets comprise a metallic material and the bonding of the first and second layers of abrasive grains to the front surfaces of the first and second perforated sheets respectively comprises electroplating.

28. The method of claim 20 wherein the first and second sheets comprise a metallic material and the bonding of the first and second layers of abrasive grains to the front surfaces of the first and second perforated sheets respectively comprises anodizing.

29. The method of claim 20 wherein the first and second sheets comprise a metallic material and the bonding of the first and second layers of abrasive grains to the front surfaces of the first and second perforated sheets respectively comprises brazing.

30. An abrasive tool, comprising:

a perforated sheet having a front surface and a back surface and perforations therein;

a layer of abrasive grains bonded to the front surface of the perforated sheet; and a unitary core made of a first material and having a first surface, the back surface of the perforated sheet disposed adjacent to the first surface of the core, the core being bonded to the perforated sheet by the core formed adjacent to the perforated sheet and the first material being disposed within the perforations of the sheet.

31. The abrasive tool according to claim 10 wherein the first material is disposed within the perforations of the first and second perforated sheets.

32. The abrasive tool according to claim 12 wherein the first material is disposed within the perforations of the first and second perforated sheets.

* * * * *